United States Patent [19]

Maioli et al.

[11] Patent Number: 4,932,448

[45] Date of Patent: Jun. 12, 1990

[54] METHOD OF TRUING-UP THE FOUR FACES OF A PIECE OF WOOD EXHIBITING SQUARED SECTION, AND A MACHINE UNIT FOR THE IMPLEMENTATION OF SUCH A METHOD

[75] Inventors: Fabio Maioli, Sant'Arcangelo; Paride Sacchi, Rimini, both of Italy

[73] Assignee: SCM Industria S.p.A., Italy

[21] Appl. No.: 311,980

[22] Filed: Feb. 16, 1989

[30] Foreign Application Priority Data

Mar. 9, 1988 [IT] Italy ..... 3364 A/88

[51] Int. Cl.[5] ..... B27C 1/08

[52] U.S. Cl. ..... 144/117 R; 144/3 R; 144/116; 144/246 R; 144/367; 144/369; 144/373

[58] Field of Search ..... 144/2 D, 3 R, 3 P, 39, 144/114 R, 116 R, 117 R, 117 B, 237, 367, 369, 374, 373

[56] References Cited

U.S. PATENT DOCUMENTS

| | | | |
|---|---|---|---|
| 2,748,814 | 6/1956 | Nunn | 144/39 |
| 2,985,205 | 3/1961 | Mann | 144/116 |
| 3,082,802 | 3/1963 | Dickson et al. | 144/117 R |
| 3,344,826 | 10/1967 | Mitten | 144/34 |
| 3,373,782 | 3/1968 | Pease | 144/116 |
| 4,196,760 | 4/1980 | McDaniel et al. | 144/116 |

*Primary Examiner*—W. Donald Bray
*Attorney, Agent, or Firm*—Darby & Darby

[57] ABSTRACT

The four sides of a batten are thicknessed and surfaced using a machine unit with a succession of tools driven by one motor and rotating horizontally throughout: a bottom planing tool incorporating a first trimming cutter at one end, a first surfacing cutter aligned with the first trimming cutter, a top planing tool incorporating a relative trimming cutter at the opposite end to that associated with the bottom planer, and a second surfacing cutter aligned with the trimming cutter of the top planing tool.

34 Claims, 7 Drawing Sheets

24
24
52
51
53
17
10
25a
25b
54

METHOD OF TRUING-UP THE FOUR FACES OF A PIECE OF WOOD EXHIBITING SQUARED SECTION, AND A MACHINE UNIT FOR THE IMPLEMENTATION OF SUCH A METHOD

BACKGROUND OF THE INVENTION

The invention relates to a method of truing-up the four faces of a piece of wood exhibiting squared cross section, and a relative machine unit.

The art field of woodworking machinery embraces a type of unit by which workpieces, and typically, longitudinal battens of essentially regular initial section, can be trued up and planed to size.

The operation of truing and surfacing a workpiece of squared section consists in removing wood from its four longitudinal faces by mechanical means. This done, i.e. with the cross-sectional dimensions being substantially to final requirements and the profile faultlessly square or rectangular, the work can be conveyed forward to successive tool stations where it is finished off and molded to a given shape, or perhaps matched with other components and glued.

In the case of further shaping, the workpiece might be tenoned, for example, in readiness for assembly as part of a door or window fixture, in which case the final step will be that of rounding off certain of the longitudinal edges, or sinking mortises in one or more of the faces.

In the case of glued pieces, these may constitute the component parts of boards, or other items of larger dimensions. In effect, there are significant practical and cost advantages in preparing a number of small battens to construct a larger board, most especially from the standpoint of economizing on materials; the economy will be evident when one considers that a finished item free of defects such as knots, splits etc. is more easily obtained from small pieces than from large.

Conventional machinery, equipment or units for truing-up the four faces of square-section work substantially comprise four planing tools, located in sequence along the path followed by the work: one beneath, with a horizontally disposed axis; one on the right flank with a vertically disposed axis; one on the left flank, also vertical; and a final horizontal tool positioned over the work, in short: bottom horizontal, vertical right, vertical left and top horizontal.

Such a unit also includes two tables, one on either side of the bottom tool (preceding and beyond), and a system of power driven feed rollers located above and operating in conjunction with the table beyond the bottom planer.

Thus, as each workpiece is fed in (manually or automatically, as may be) and advanced along the first table, the bottom face is planed to provide a reference for the remaining steps of the procedure; the work then passes onto the second table, which is aligned with the crest of the rotating bottom planer tool, and into contact with the overhead feed rollers which propel it forward through the tool stations that plane the right and the left faces and the top.

The various tools and feed systems are driven by individual respective motors, or, less typically, the tools are driven in pairs by one horizontally disposed motor and one vertically disposed motor, respectively.

Machines of the type thus outlined are beset by the drawback of a limited range of working adjustment, however, and of the fact that the finish produced on the right and left hand faces is not well suited to receive glue, should the workpiece be destined for subsequent bonding. More exactly, the vertical tools in these conventional machines are planers, just like the horizontal tools, and both produce a final surface that is smooth, and undulated through given stretches.

By contrast, experience in the field has shown that the surface best suited for bonding is that cut by a blade, i.e by a saw blade: a sawn cut does not compress the pores of the timber in the same way as a planing pass; instead, the surface is roughened, and thus better able to absorb the adhesive applied to it in correct fashion. Moreover, the undulations left by planing permit the formation of a film of glue between matched and bonded surfaces, which is visible from the outside and spoils the appearance of the finished item.

Accordingly, the object of the present invention is to set forth a method of truing the four faces of a piece of wood in such a way as to ensure that no splinters are produced, and that the side faces of any two pieces are rendered suitable for bonding with adhesive one to another, whilst retaining the levels of accuracy currently obtainable with a unit of conventional design.

Another object of the invention, gained by adoption of the constructional design of a unit as envisaged herein, is to provide machinery of singularly low manufacturing and running costs, ensured not least by virtue of its low power specification.

SUMMARY OF THE INVENTION

The stated objects are realized with the method and the machine unit disclosed, according to which, the truing operation is effected with two horizontal planer tools, bottom and top, each provided with a trimming cutter at one end, one right and one left, and two horizontal axis surfacing cutters engaging the right and left hand side faces of the work, respectively.

All the tool shafts in the unit are belt-driven from one motor, and the top planer is supported at each end by a horizontally mobile slide that can be traversed across the path followed by the work, and adjusted for vertical position.

A first advantage of the invention stems from the compact design of the machine unit, achieved not least as a result of adopting a drive utilizing just one motor. Single motor drive also provides a significant advantage in terms of cost, especially for small joinery and craft concerns where overall running time of the machine generally far outweighs its effective operating time. With the one-motor machine unit disclosed, in effect, time spent in the idle power-on state is less costly to the user than would be the case with a multi-motor unit.

Another advantage of the machine unit disclosed is that of the ease with which adjustments can be made to accommodate the varying dimensions of different work put through, simply by traversing and raising or lowering the slide to set the position of the left hand cutter and the top horizontal planer. Yet another advantage of the invention is that it provides the option, in the case of the right and left hand tools, at least, of utilizing detachable and reversible cutter inserts for better finishing and greater durability.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
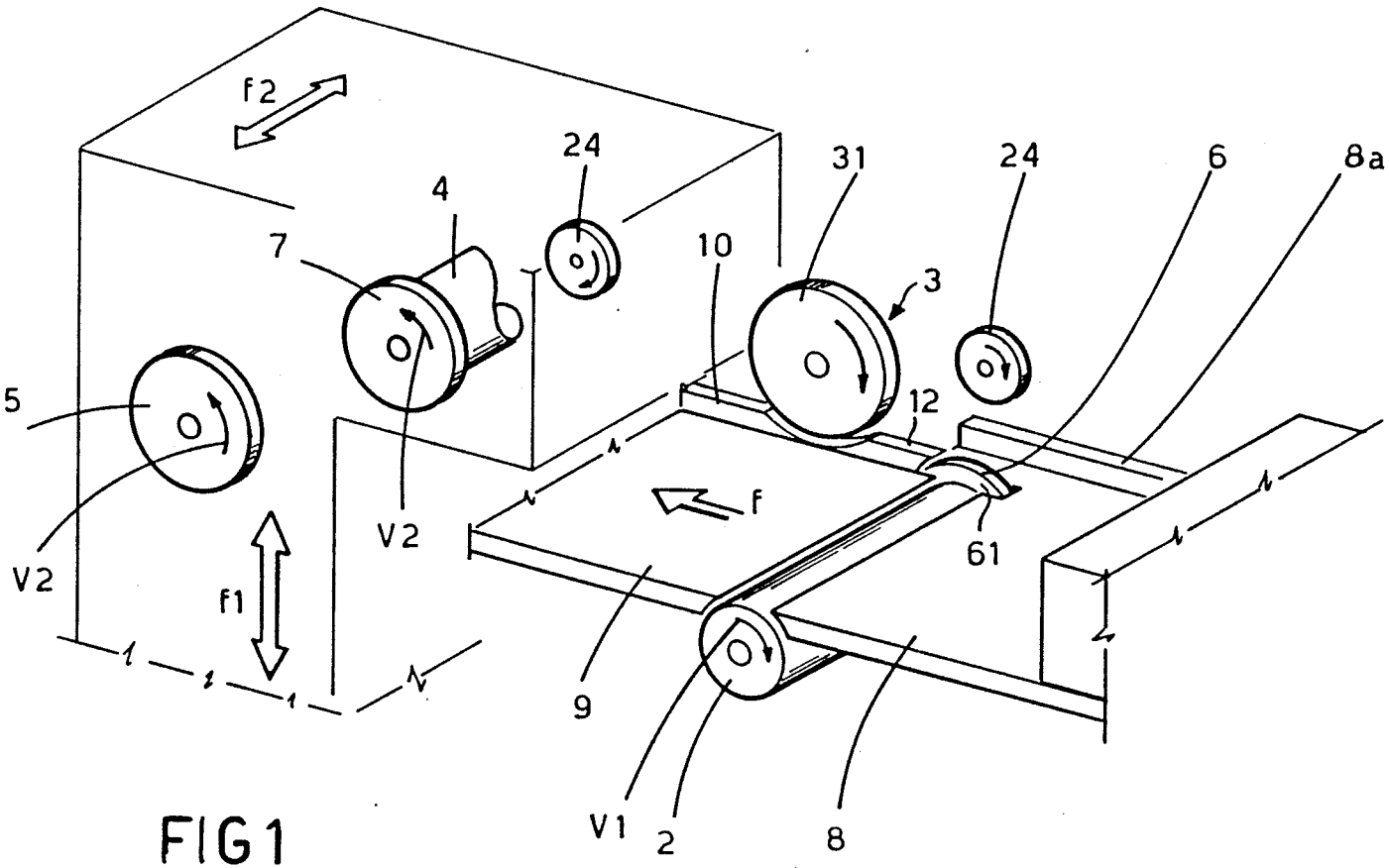
FIG. 1 is a perspective, schematically illustrating the main features of the machine unit disclosed.
Figure 2A:
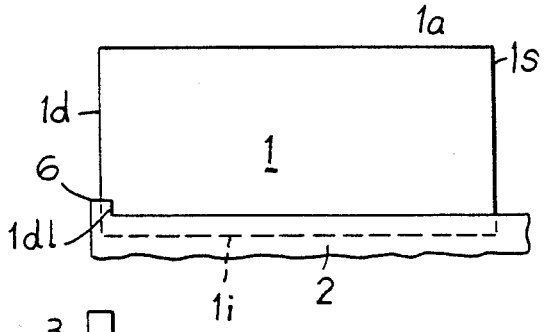
FIG. 2 shows a workpiece in a series of elevations, viewed from the runout end of the machine unit, which illustrate the essential steps of the method as applied to work having a rectangular cross section.
Figure 2B:
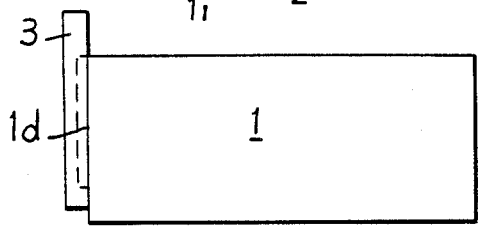
Figure 2C:
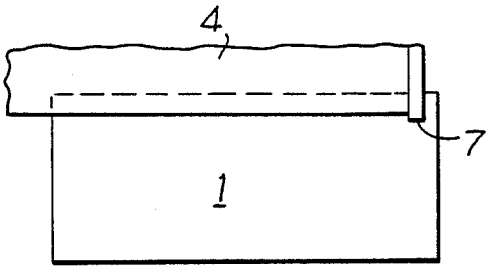
Figure 2D:
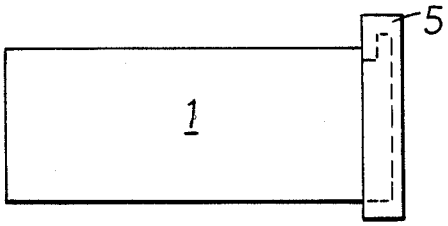

With reference first to FIG. 2, the method according to the invention for truing-up the four faces of a piece of wood 1 comprises the steps of:

- surfacing the bottom face 1*i* by means of a bottom horizontal axis planing tool 2;
- squaring the bottom edge of one side face 1*d* by means of a first horizontal axis trimming cutter 6 associated with the bottom planing tool 2;
- surfacing at least the remaining area of the same side face 1*d* by means of a first horizontal axis cutter 3, the vertical face of which occupies the same plane as that occupied by the vertical face of the first trimming cutter 6;
- surfacing the top face 1*a* with a top horizontal axis planing tool 4;
- surfacing the remaining side face 1*s* by means of a second horizontal axis cutter 5.

In the illustration of the preferred method shown in FIG. 1 (which also provides a schematic of the machine unit), it will be seen that, prior to the final step of surfacing the second side face 1*s* with the second cutter 5, the top edge of this same face 1*s* is squared off by a second horizontal axis trimming cutter 7 associated with the top planing tool 4; in this situation, the second surfacing cutter 5 will be stationed further along the unit, disposed with its vertical cutting face occupying the same plane as that occupied by the face of the second trimming cutter 7.

To best advantage, the two trimming cutters 6 and 7 will be embodied integrally with the respective planing tools 2 and 4, as discernable from FIGS. 1 and 2. Accordingly, the steps of planing the bottom face 1*i* and trimming the bottom edge of the right hand side face 1*d* will be effected simultaneously, as also will be the steps of planing the top face 1*a* and trimming the top edge of the left hand side face 1*s*. Adopting the method disclosed, moreover, the side faces 1*d* and 1*s* of the work 1 are surfaced with a radial cutting action the effects of which are identical to those of a sawn cut, and namely, such as to produce degrees of surface roughness and porosity that will enable battens to be matched and glued together faultlessly one with the next.

Still with reference to FIG. 1, a machine unit for implementation of the method disclosed essentially comprises:

- a horizontal axis bottom planing tool 2;
- a first horizontal axis trimming cutter 6;
- a first horizontal axis surfacing cutter 3;
- a horizontal axis top planing tool 4;
- a second horizontal axis trimming cutter 7;
- a second horizontal axis surfacing cutter 5;
- feed means 24, with axis horizontally disposed;
- two work tables 8 and 9 located at dissimilar heights one on either side of the bottom planing tool 2, preceding and beyond, respectively, in relation to the path f of the work, of which the second table 9 occupies the same plane as that occupied by the topmost crest of the bottom planing tool 2, and is the higher table of the two;
- a first side fence 12 positioned in alignment with and located beyond the first trimming cutter 6, and a second side fence 10 aligned with and beyond the first surfacing cutter 3.

The two cutters 3 and 6 on the one side must be positioned in mutual alignment, at least inasmuch as their relative vertical cutting faces 31 and 61 must be aligned, and the same applies in the case of the cutters 5 and 7 at the remaining side.

In a preferred embodiment of the unit, the first trimming cutter 6 will be integral with the end of the bottom planing tool 2, and the second trimming cutter 7 with the end of the top planing tool 4; needless to say, the two cutters 6 and 7 occupy positions at opposite sides of the table 8 so as to engage the right and left hand faces of the work 1, respectively.

For convenience of description, and of comparison with conventional planer surfacing machines, the bottom planing tool 1 may be referred to throughout as the bottom horizontal tool, the first surfacing cutter 3 as vertical Rx, the top planing tool 4 as top horizontal, and the second surfacing cutter 5 as vertical Lx. Notwithstanding 'vertical' is a misnomer, in effect, when applied to the right and left hand cutters 3 and 5, given that the axes of these two tools are horizontally disposed, or at all events, are not upright, the reference is used essentially to distinguish the right hand side 1*d* and the left hand side 1*s* of the work 1 (see FIG. 2) fed into the unit.

The first side fence 12, which flanks the stretch of the table 9 between the bottom horizontal tool 2 and the vertical Rx tool 3, is lower in height than the radial difference between the trimming cutter 6 and the planing tool 2 (that is, less in height than the full penetration depth of the cutter 6), and positioned flush with the vertical cutting face denoted 61.

The first work table 8 is supported by a base 15, adjustable for height to allow of varying the depth of cut effected with the bottom horizontal tool 2, and provided with an adjustable fence 8*a* located on the same side as the fences 10 and 12 mentioned above; more exactly, the fence 8*b* in question can be offset transversely from the first fence 12 through a distance, measured along the axis of the bottom horizontal tool 2, that corresponds to the thickness of the wood to be removed from the right hand face 1*d* of the work 1.

Figure 4:
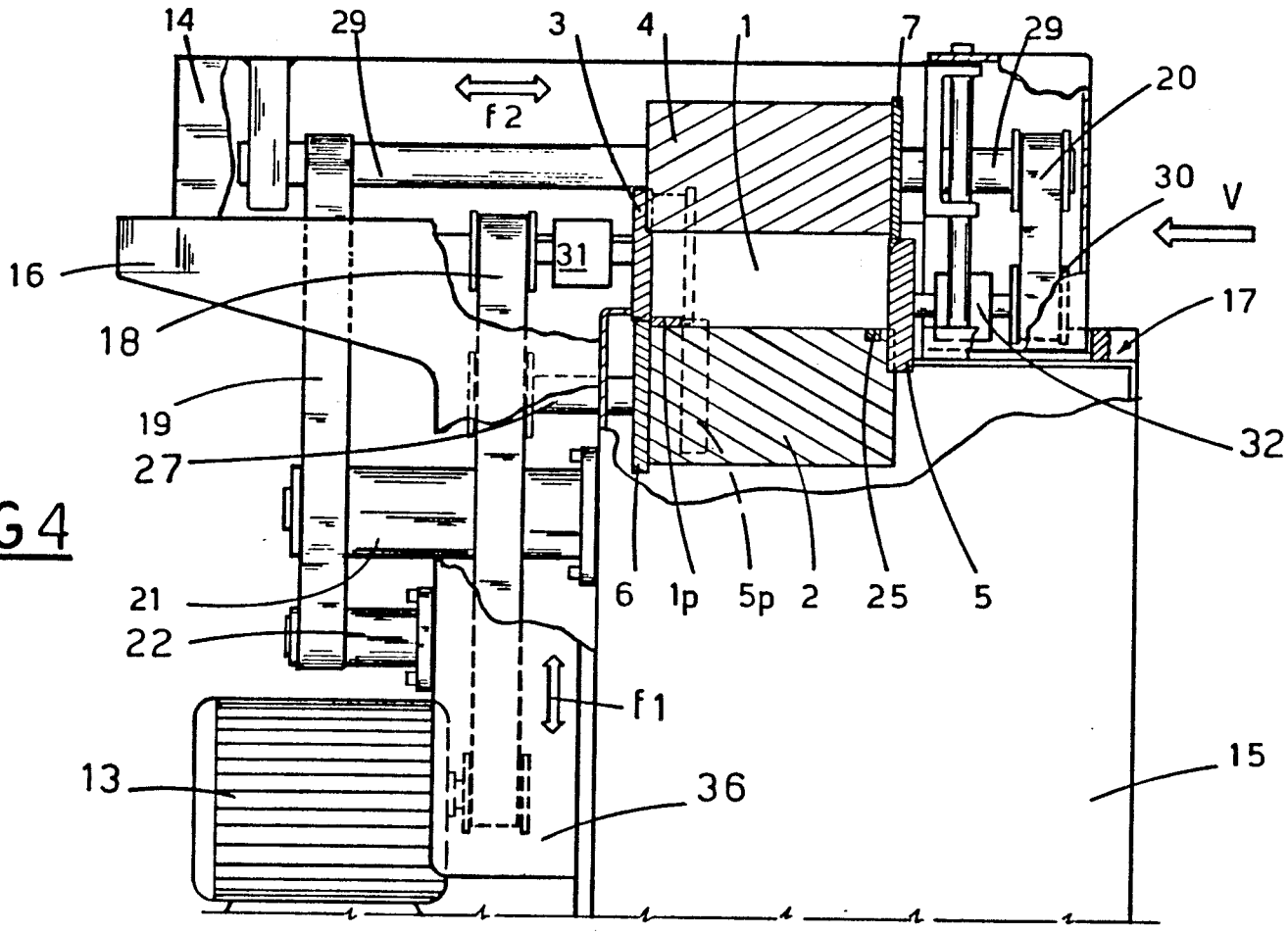
FIG. 4 is a schematic elevation of the machine unit disclosed, viewed from the end at which finished work runs out.
Figure 5:
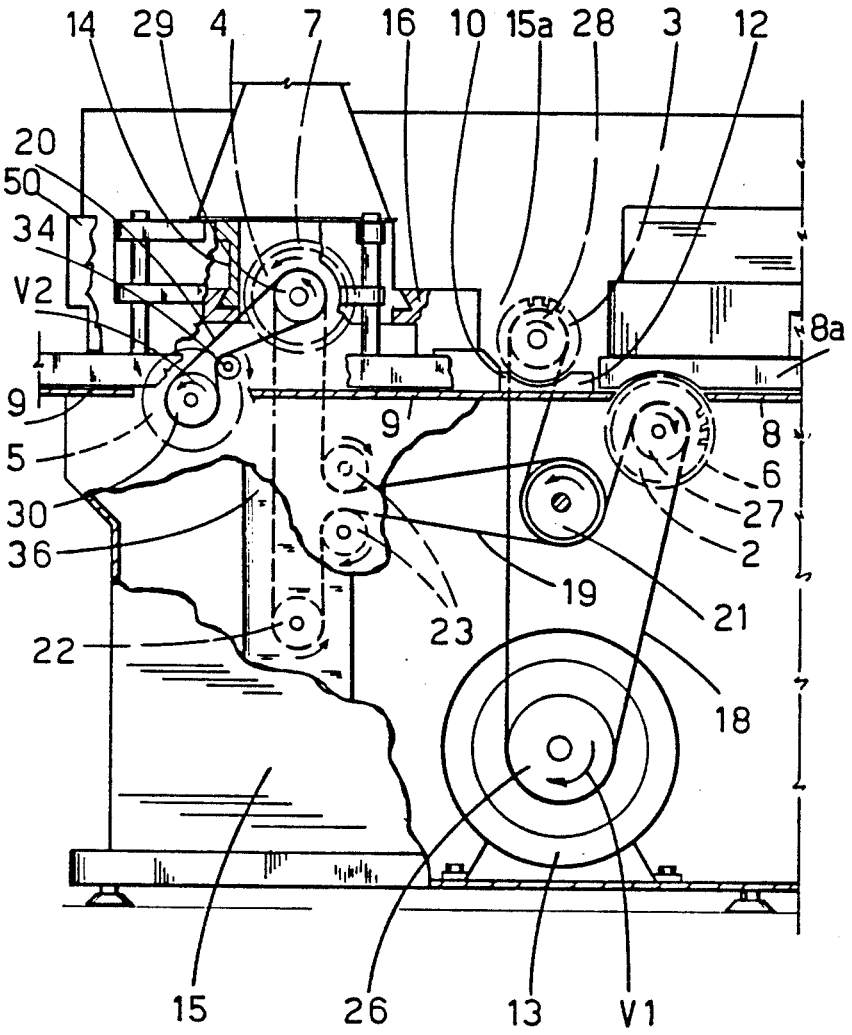
FIG. 5 is a further schematic elevation of the unit illustrated in FIG. 4, viewed from standpoint V with certain parts omitted better to reveal others.

Referring to FIGS. 4 and 5, the vertical Rx tool 3 is carried by an extension 15*a* of the base 15, fitted to a spindle 31 that can be adjusted axially for the purposes of aligning the tool 3 with the right hand trimming cutter 6 (FIG. 4).

Figure 3:
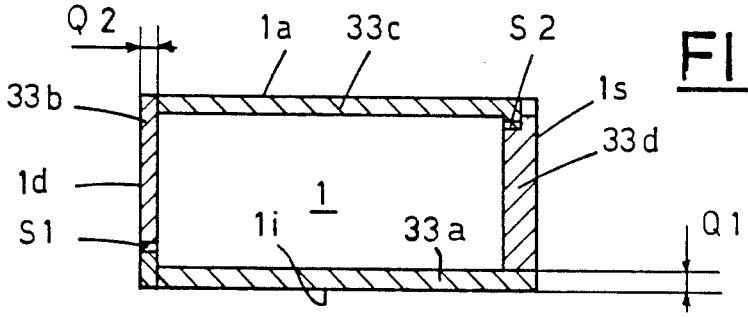
FIG. 3 is a similar elevation to that of FIG. 2, which illustrates the initial, intermediate and final cross sections of a workpiece trued up by implementation of the method disclosed.

The height at which the vertical Rx tool 3 is set will be such that the area of the face 1*d* cleared by its cutting action overlaps a short vertical distance, denoted S1 in FIG. 3, with the bottom part prepared previously by the trimming cutter 6.

More exactly, by effecting an initial removal of material from the bottom edge 1*i* with the trimming cutter 6, which sinks a marginal depth into the work, the edge of the face 1*d* is rendered true, and accurate finishing is ensured by the radial action of the cutter 3; thus, the bottom face 1*i* emerges from the cut free of the splinters which would be produced were the vertical Rx tool 3 to engage the full width of the side face 1*d*.

The top horizontal tool 4 and vertical Lx tool 5 are both overhung, mounted directly and by way of an axially adjustable spindle 32, respectively, to a horizontal slide 14 of hollow parallelepiped embodiment, capable of traversing horizontally left and right across the path f of the workpieces 1 in the direction of the arrow denoted f2; the slide 14 runs on ways 16 integral with the top of a knee 36 at the rear of the machine, which is carried by and capable of traversing vertically in relation to the base 15. FIG. 5 provides a schematic illustration of the slide 14 and its ways 16 from the standpoint denoted V, showing their matching dovetail profile; the assembly will also include conventional drive and clamping means, which are not illustrated in the interests of simplicity.

Figure 6:
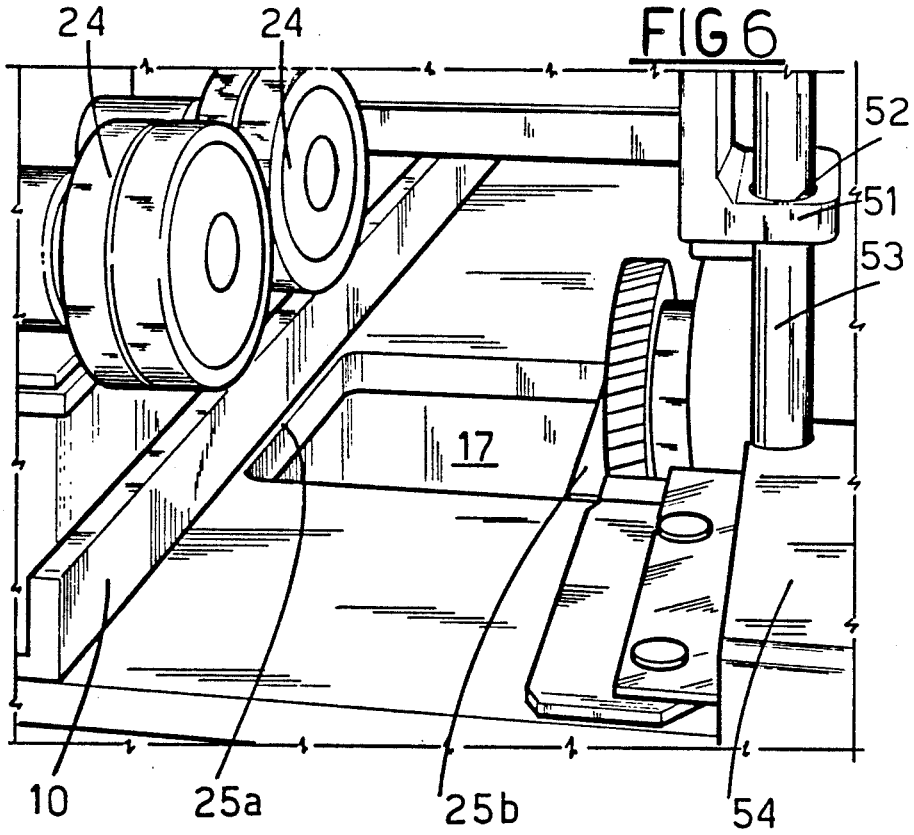
FIG. 6 is a perspective showing the end section of the machine unit, from which the work runs out.
Figure 7:
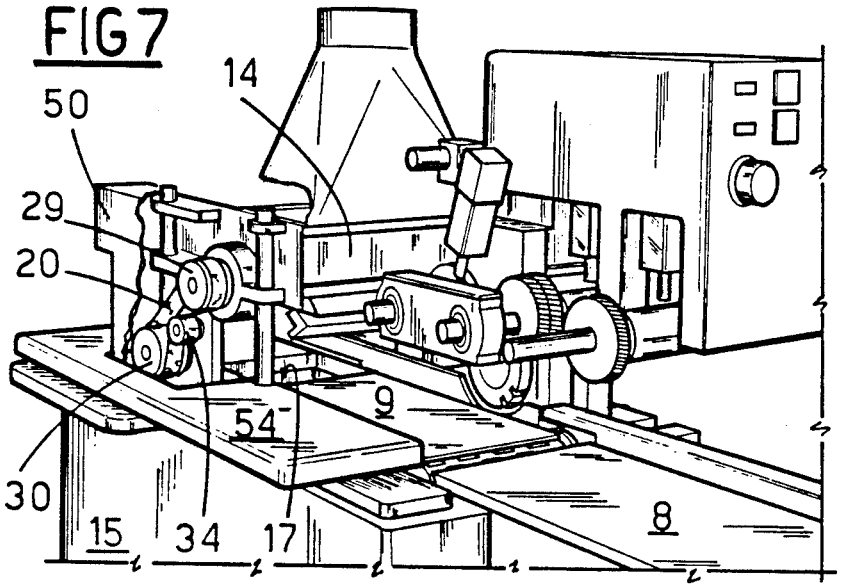
FIG. 7 is a front perspective of the machine unit disclosed, which shows the end opposite to that seen in FIG. 6.

Also mounted to the base 15 are feed means 24, consisting in a plurality of power driven rollers rotatable about horizontal axes, which operate in conjunction with the second table 9. Again, in the interests of simplicity, two such rollers 24 only are illustrated in FIG. 1, preceding and beyond the vertical Rx tool 3; in practice however, the number could be greater, for example as shown in FIG. 6. Such rollers would be rubber faced, if installed beyond the top planing tool 4, and perhaps serrated in the case of rollers preceding the same tool 4, this being a distinction that would need to be observed in view of the fact that the top face 1*a* remains unfinished prior to passing beneath the top tool 4, whereas beyond the tool, the surfaced and thicknessed work must not be exposed to potentially damaging mechanical pressures.

17 denotes a transverse gap afforded by the base 15 (or rather, the second table 9) coinciding with the face of the vertical Lx tool 5 directed toward the work 1, which accommodates a pair of support rails 25*a* and 25*b* (FIGS. 4 and 6). Such a gap is required in order to accommodate the horizontal movement of the two suspended tools 4 and 5, the reason for which will become clear in due course; 50 denotes a guard encasing the two tools on the left hand side.

More exactly, the left hand end of the slide 14 exhibits an L-shaped bracket 51 affording a pair of vertical sockets 52; these serve to accommodate relative posts 53, the bottom ends of which rigidly associated with a horizontal plate 54 that rests permanently on the table 9 beneath by reason of its own weight, and thus serves advantageously as a mounting for the left hand support rail 25*b*, which embraces the vertical Lx tool 5 as illustrated in FIG. 6, in particular.

The various tools 2, 3, 4 and 5 are driven from a single motor 13 anchored to and housed within the base 15, as also are the work feed rollers 24 (the transmission to the rollers is not illustrated). Drive is transmitted to the tools 2, 3, 4 and 5 by way of belts, which in a preferred embodiment will be of a flat type (see FIG. 5).

Referring now to FIG. 5 in detail, 26 denotes a pulley keyed to the shaft of the motor 13, around which a first flat belt 18 is looped; the belt 18 is passed around a second pulley 27 keyed to the bottom horizontal tool 2, then around a take-off pulley 21 and a further pulley 28 keyed to the vertical Rx tool 3 before returning to the motor. 19 denotes a second flat belt, driven from the take-off pulley 21 (in effect, an overhung shaft), which is looped around a return pulley 22 carried by the knee 36 then around a pulley 29 keyed to the top horizontal tool 4, passing in addition over intermediate idlers 23 carried by the base 15. 20 denotes a third flat belt, looped around the top pulley 29 and a pulley 30 keyed to the vertical Lx tool 5, which passes over an idle pulley 34 carried by the cross slide 14.

It will be seen from FIG. 4 that the top pulley 29 is one and the same as a long transverse shaft passing through the relative horizontal tool 4; thus, the entire assembly of slide 14 and tools 4 and 5 can be traversed bodily along the ways 16 with the motor 13 running, given that the relative belt 19 is flat, and the axially mobile shaft 29 has no difficulty in slipping through the loop. The manner in which the second belt 19 is looped also enables the top and return pulleys 29 and 22 to shift vertically in relation to the idlers 23 and the take-off pulley 21, without any variation occurring in the overall length of the loop.

FIGS. 1 and 5 illustrate how the bottom horizontal and the vertical Rx tools 2 and 3 are driven by the one belt 18, both the relative pulleys 27 and 28 being engaged by the inside face of the belt, and thus rotating in the same direction V1. The same applies in the case of the top horizontal tool 4 and the vertical Lx tool 5, which are connected by the third belt 20 and rotate in the same direction, denoted V2.

In a machine unit thus embodied, adjustment of the position of the vertical Rx tool 3 in relation to the bottom horizontal tool 2, and of the vertical Lx tool 5 in relation to the top horizontal tool 4, will be effected only in the event that the tools themselves are replaced, entirely or in part, due to wear. In any other situation, i.e. a change in dimensions of the work 1, it suffices to select the corresponding position of the slide 14 along its ways 16, and raise or lower the ways 16 themselves to the appropriate height; advantage is gained by virtue of the fact that the tools will handle work of varying dimensions within a generous overall range, e.g. from a minimum 25 mm-wide by 8 mm-thick to a maximum 250 mm-wide by 100 mm-thick.

To gain such flexibility in thicknessing without effecting adjustments to the structure of the unit, the expedient of the transverse gap 17 is adopted. Where the work handled is of significantly small dimensions, as in the case of the piece denoted 1*p* in FIG. 4, the vertical Lx tool 5 needs to drop almost completely below the level of the table 9, with its topmost crest positioned just below the finished top face of the work 1*p* (phantom line 5*p*). Accordingly, the dimensions of the gap 17 will be generous enough to permit handling work both of reduced thickness, and of notable width.

It is the presence of the gap 17 that dictates the need for the rails 25*a* and 25*b*, which are located alongside the side fence 10 and the vertical Lx tool 5, respectively; without the rails, the work 1 would not be supported from beneath, and distortion could well occur under the bending and twisting action of the tool, most notably on the left flank. It will be observed, in fact, that if work 1 of greater than 100 mm thickness is to be surfaced, the diameter of the vertical Lx tool 5 will need to be larger, and the width of the gap 17 larger still. In order to permit of surfacing particularly thin work, the first trimming cutter 6 will project no further than 10 mm from the bottom planing tool 2, and the second trimming cutter 7 no further than 5 mm from the top planing tool 4. Accordingly, the first side fence 12 will stand no higher than 9 mm approx from the work table 9.

Before truing-up the four faces of a given piece 1 with a machine unit thus embodied, the operator will first select the height of the first table 8 in relation to the crest of the bottom horizontal tool 2, according to the depth of material to be removed from the bottom face 1*i* (Q1, in FIG. 3), and then set the distance between the fences 8*a* and 12 according to the depth of cut required at the right hand side face 1*d* (Q2, in FIG. 3). This done, the cross slide 14 is traversed along the ways 16, and the knee 36 adjusted for height, to give the final width and thickness of the finished piece 1.

Freedom of vertical movement (arrow f1, FIG. 4) is allowed to the knee 36 by virtue of the idlers 23 and the return pulley 22, which enable the top and bottom pulleys 29 and 22 to traverse vertically without occasioning any variation in overall length of the relative belt loop 19. Horizontal traverse of the cross slide 14 (arrow f2, FIG. 4), effected by conventional means, is enabled by the ability of the flat belt 19 to slip along the planer shaft 29 as the slide 14 is traversed.

Adjustments having been made, the unit is ready to operate, and the work 1 will emerge thicknessed to a depth equal to the distance between the top and bottom crests of the bottom and top planing tools 2 and 4, and to a width equal to the distance between the opposed vertical faces of the right and left hand surfacing cutters 3 and 5.

The single workpiece 1 is offered to the table 8 with one side against the relative side fence 8*a* and pushed toward the bottom horizontal tool 2-6, which duly engages the bottom face 1*i* (see FIG. 2*a*) and the bottom right hand edge 1*dl*, removing the section denoted 33*a* in FIG. 3. Immediately beyond the first tool 2, the work 1 encounters the feed rollers 24, which carry it forward along the second table 9 with the trimmed edge 1*dl* of the right hand side face 1*d* flush against the relative fence 12; accordingly, the piece 1 is properly positioned even at this comparatively early stage, given that one finished and squared edge 1*dl* registers firmly in contact with two corresponding and mutually perpendicular reference surfaces. Next, the right hand side face 1*d* will enter into contact with the vertical Rx tool 3 (FIG. 2*b*), which removes the section denoted 33*b* (FIG. 3). It will be observed that these two sections 33*a* and 33*b* overlap through a section of depth denoted S1, which is the result of ensuring faultless alignment of the faces 61 and 31 of the trimming and surfacing cutters so that the area cleared initially by the trimming cutter 6 affords an unobstructed passage to the bottom edge of the surfacing cutter 3.

Next, the top face 1*a* of the work is surfaced by the relative horizontal tool 4 (FIG. 2*c*), which will remove the section denoted 33*c* in FIG. 3, whereupon the final pass (FIG. 2*d*) is made by the vertical Lx tool 5 to remove the section denoted 33*d* in FIG. 3.

These two sections 33*c* and 33*d* likewise overlap for a short depth (S2), which is cleared initially by the Lx trimming cutter 7 in readiness for passage of the Lx surfacing cutter 5.

By including the two trimming cutters 6 and 7, it becomes possible to penetrate a short way into the two side faces 1*d* and 1*s* from one edge exploiting a radial cutting action, and thus prevent splintering of the bottom and top faces 1*i* and 1*a* at the edges in question by substantially avoiding the force which typically causes wood to splinter, i.e. that of a cutting stroke directed away from the work; in effect, the vertical Rx and Lx surfacing cutters 3 and 5 remain distanced from the relative horizontal faces 1*i* and 1*a*, and no splintering occurs.

To handle work 1 of dimensions other than those for which the unit is currently set up, it suffices to re-position the slide 14 and the ways 16 at the new width and depth measurements, respectively.

The foregoing description refers to an independent machine unit, though it is clear enough that the same unit might equally well be integrated into and driven by a larger combination or universal type machine.

At all events, the unit disclosed affords economy of manufacture and low running costs. In smaller joinery and craft workshops in particular, where the hours spent in cutting are effectively far less than the total running hours of the machine, one motor only will remain switched on, and this runs idle only when none of the tools 2, 3, 4 or 5 is engaged by a workpiece 1.

No less advantageous is the compact design of the unit, achieved by virtue of there being one motor only, and as a result of tooling with horizontal axis planers and cutters throughout.

What is claimed:

1. A method of truing-up the four faces of a piece of wood exhibiting squared section, comprising the steps of:

surfacing the bottom face of the work by means of a bottom horizontal axis planing tool;

squaring the bottom edge of a first side face of the work by means of a first horizontal axis trimming cutter;

guiding the work along a side fence of height no greater than the difference in radial width between the concentrically aligned bottom planing tool and first trimming cutter;

surfacing at least the remaining area of the first side face by means of a first horizontal axis cutter, of which at least the vertical face offered to the work occupies the same plane as that occupied by the vertical face of the first trimming cutter;

surfacing the top face of the work by means of a top horizontal axis planing tool;

squaring the top edge of the remaining side face of the work by means of a second horizontal axis trimming cutter;

surfacing at least the remaining area of the remaining side face by means of a second horizontal axis cutter, of which at least the vertical face offered to the work occupies the same plane as that occupied by the vertical face of the second trimming cutter.

2. A method of truing-up the four faces of a piece of wood exhibiting squared section, comprising the steps of:

surfacing the bottom face of the work by means of a bottom horizontal axis planing tool;

squaring the bottom edge of a first side face of the work by means of a first horizontal axis trimming cutter;

guiding the work along a side fence of height no greater than the difference in radial width between the concentrically aligned bottom planing tool and first trimming cutter;

surfacing at least the remaining area of the first side face by means of a first horizontal axis cutter, of which at least the vertical face offered to the work occupies the same plane as that occupied by the vertical face of the first trimming cutter;

surfacing the remaining side face of the work by means of a second horizontal axis cutter;

surfacing the top face of the work by means of a top horizontal axis planing tool.

3. A method as in claim 1, wherein the steps of surfacing the side faces of the work involve.-vertically overlapping the passes effected with the respective trimming cutters and surfacing cutters.

4. A method as in claim 1, wherein the steps of surfacing the bottom face and squaring the bottom edge of one adjacent side face of the work are effected simultaneously by means of a bottom planing tool of cylindrical embodiment, rotatable about a horizontal axis and provided with a first trimming cutter that projects from its cylindrical surface.

5. A method as in claim 2, wherein the steps of surfacing the bottom face and squaring the bottom edge of one adjacent side face of the work are effected simultaneously by means of a bottom planing tool of cylindrical embodiment, rotatable about a horizontal axis and provided with a first trimming cutter that projects from its cylindrical surface.

6. A method as in claim 1, wherein the steps of surfacing the top face and squaring the top edge of the remaining side face of the work are effected simultaneously by means of a top planing tool of cylindrical embodiment rotatable about a horizontal axis and provided with a second trimming cutter that projects from its cylindrical surface.

7. A machine unit for truing-up the four faces of a piece of wood exhibiting squared section, comprising:

a first table serving to support the work;

a bottom horizontal axis planing tool for surfacing the bottom face of the work, projecting above the first table;

a first horizontal axis trimming cutter for squaring the bottom edge of a first side face of the work and a first horizontal axis surfacing cutter for surfacing at least the remaining area of the first side face, disposed with axes parallel, of which at least the respective vertical faces offered to the work are aligned within a common plane;

a second work table, positioned beyond the bottom planing tool along the path followed by the work;

at least one side fence, aligned with and positioned beyond the first trimming cutter along the path followed by the work, and of height less than the distance to which the first trimming cutter projects from the bottom planing tool;

a top horizontal axis planing tool for surfacing the top face of the work, positioned above the work;

at least one second horizontal axis surfacing cutter for surfacing at least the remaining area of the remaining side face of the work, facing the first surfacing cutter;

means by which the work is fed from one tool to the next, positioned above and operating in combination with at least the second table.

8. A machine unit for truing-up the four faces of a piece of wood exhibiting squared section, comprising:

a first table serving to support the work;

a bottom horizontal axis planing tool for surfacing the bottom face of the work, projecting above the first table;

a first horizontal axis trimming cutter for squaring the bottom edge of a first side face of the work and a first horizontal axis surfacing cutter for surfacing at least the remaining area of the first side face, disposed with axes parallel, of which at least the respective vertical faces offered to the work are aligned within a common plane;

a second work table, positioned beyond the bottom planing tool along the path followed by the work;

at least one side fence, aligned with and positioned beyond the first trimming cutter along the path followed by the work, and of height less than the distance to which the first trimming cutter projects from the bottom planing tool;

a top horizontal axis planing tool for surfacing the top face of the work, positioned above the work;

at least one second horizontal axis surfacing cutter for surfacing at least the remaining area of the remaining side face, facing the first surfacing cutter;

means by which the work is fed from one tool to the next, positioned above and operating in combination with at least the second table.

9. A unit as in claim 7, wherein the top planing tool and the second surfacing cutter are carried by a slide capable of traversing vertically and horizontally, respectively at right angles to and parallel with the axes of the bottom planing tool and the first surfacing cutter, in such a way that the top planing tool and the second surfacing cutter can be moved toward and away from the bottom planing tool and the first surfacing cutter.

10. A unit as in claim 8, wherein the top planing tool and the second surfacing cutter are carried by a slide capable of traversing vertically and horizontally, respectively at right angles to and parallel with the axes of the bottom planing tool and the first surfacing cutter, in such a way that the top planing tool and the second surfacing cutter can be moved toward and away from the bottom planing tool and the first surfacing cutter.

11. A unit as in claim 7, comprising a second horizontal axis trimming cutter for squaring the top edge of the remaining side face of the work, preceding the second surfacing cutter along the path followed by the work, wherein the second trimming cutter and the second surfacing cutter are disposed with axes parallel, and offer respective vertical faces to the work that are aligned within a common plane.

12. A unit as in claim 8, comprising a second horizontal axis trimming cutter for squaring the top edge of the remaining side face of the work, preceding the second surfacing cutter along the path followed by the work, wherein the second trimming cutter and the second surfacing cutter are disposed with axes horizontal and parallel, and offer respective vertical faces to the work that are aligned within a common plane.

13. A unit as in claim 7, wherein the first trimming cutter and the first surfacing cutter are made to rotate in the same direction as that of the bottom planing tool.

14. A unit as in claim 8, wherein the first trimming cutter and the first surfacing cutter are made to rotate in the same direction as that of the bottom planing tool.

15. A unit as in claim 11, wherein the second trimming cutter and the second surfacing cutter are made to rotate in the same direction as that of the top planing tool, and in the opposite direction to that of the bottom planing tool.

16. A unit as in claim 12, wherein the second trimming cutter and the second surfacing cutter are made to rotate in the same direction as that of the top planing tool, and in the opposite direction to that of the bottom planing tool.

17. A unit as in claim 7, wherein the first trimming cutter is associated with one end of the bottom planing tool.

18. A unit as in claim 8, wherein the first trimming cutter is associated with one end of the bottom planing tool.

19. A unit as in claim 11, wherein the second trimming cutter is associated with one end of the top planing tool.

20. A unit as in claim 12, wherein the second trimming cutter is associated with one end of the top planing tool.

21. A unit as in claim 7, wherein the first trimming cutter and the first surfacing cutter are positioned in such a way that the area of the work engaged by the one overlaps through a given vertical distance with that engaged by the other.

22. A unit as in claim 8, wherein the first trimming cutter and the first surfacing cutter are positioned in such a way that the area of the work engaged by the one overlaps through a given vertical distance with that engaged by the other.

23. A unit as in claim 11, wherein the second trimming cutter and the second surfacing cutter are positioned in such a way that the area of the work engaged by the one overlaps through a given vertical distance with that engaged by the other.

24. A unit as in claim 12, wherein the second trimming cutter and the second surfacing cutter are positioned in such a way that the area of the work engaged by the one overlaps through a given vertical distance with that engaged by the other.

25. A unit as in claim 7, wherein the top planing tool and the second surfacing cutter are carried by a slide capable of traversing horizontally in a direction transverse to a base carrying the bottom planing tool and the first surfacing cutter, and mounted on ways rigidly associated with a knee supported by and capable of vertical movement in relation to the base, traversing perpendicular to the axes of the cutters; and wherein the top planing tool is supported by the slide at each end, and the second surfacing cutter is capable of movement along and/or internally of a transverse gap afforded by the second work table.

26. A unit as in claim 8, wherein the top planing tool and the second surfacing cutter are carried by a slide capable of traversing horizontally in a direction transverse to a base carrying the bottom planing tool and the first surfacing cutter, and mounted on ways rigidly associated with a knee supported by and capable of vertical movement in relation to the base, traversing perpendicular to the axes of the cutters; and wherein the top planing tool is supported by the slide at each end, and the second surfacing cutter is capable of movement along and/or internally of a transverse gap afforded by the second work table.

27. A machine unit for truing-up the four faces of a piece of wood exhibiting squared section, comprising, substantially in sequence:

a first table serving to support the work;

a bottom planing tool, disposed with axis horizontal and provided with a respective first trimming cutter at one end;

a first surfacing cutter, disposed with axis horizontal and rotated in the same direction as that of the bottom planing tool, of which at least the vertical face offered to the work is aligned in a common plane with the corresponding face of the first trimming cutter;

a second work table, positioned beyond the bottom planing tool;

at least one side fence, positioned in alignment with and beyond the first trimming cutter, and of height less than the cutting depth of the first trimming cutter;

a side fence aligned with and positioned beyond the first surfacing cutter;

a top planing tool, disposed with axis horizontal and provided with a respective second trimming cutter at one end;

a second surfacing cutter, disposed with axis horizontal and rotated in the same direction as that of the top planing tool, of which at least the vertical face offered to the work is aligned in a common plane with the corresponding face of the second trimming cutter;

means by which the work is fed from one tool to the next, positioned above and operating in combination with at least the second table; and horizontally slidable means, carrying the top planing tool and second trimming cutter together with the second surfacing cutter, and vertically slidable means, associated with a base and supporting the horizontally slidable means, whereby the top planing tool and second cutters can be traversed horizontally and vertically toward and away from the bottom planing tool and the first cutters.

28. A unit as in claim 27, wherein the bottom and top planing tools and the first and the second cutters are driven in rotation by a single motor.

29. A unit as in claim 27, wherein the bottom and top planing tools and the first and the second cutters are driven in rotation from a single motor by a transmission comprising:

a first belt, looped around a pulley driven by the motor, around pulleys keyed respectively to the bottom planing tool and the first surfacing cutter, and around a take-off pulley carried by the base;

a second belt, looped around the take-off pulley, around a pulley keyed to the top planing tool, around a return pulley carried by the vertically slidable means and around two idlers carried by the base;

a third belt, looped around the pulley keyed to the top planing tool, hence to the second trimming cutter, and around a pulley keyed to the second surfacing cutter.

30. A unit as in claim 27, wherein the top planing tool and the second surfacing cutter are carried by the horizontally slidable means in such a way as to traverse at right angles to the base, considered in relation to the path followed by the work, with the planing tool supported at both ends and the second surfacing cutter capable of movement along and/or internally of a transverse gap afforded by the second work table.

31. A unit as in claim 30, further comprising at least one rail, located alongside the face of the second surfacing cutter offered to the work and bridging the transverse gap in the second work table, which is adjustable for position in relation to the gap together with the second surfacing cutter and serves to support the edge of the work passing nearest to the cutter.

32. A unit as in claim 31, wherein the transverse gap in the second work table is bridged by a pair of support rails located one on either side of the encompassed space in relation to the path followed by the work.

33. A unit as in claim 27, wherein each surfacing cutter is mounted to a relative spindle by means of which the relative vertical face offered to the work can be adjusted for axial position in relation to the respective trimming cutter.

34. A unit as in claim 29, wherein the pulley associated with the top planing tool consists in a shaft along which the second belt, driven from the take-off pulley with the motor switched on and running, is able to shift as the horizontally slidable means are traversed.

* * * * *